US011799244B2

(12) United States Patent
Duan et al.

(10) Patent No.: US 11,799,244 B2
(45) Date of Patent: Oct. 24, 2023

(54) CONNECTOR WITH SHIELDING ELASTIC PIECE AND CONNECTOR ASSEMBLY

(71) Applicant: Dongguan Luxshare Technologies Co., Ltd, Dongguan (CN)

(72) Inventors: BaiYu Duan, Dongguan (CN); Zhen Luo, Dongguan (CN); XiaoKai Wang, Dongguan (CN); XiaoPing Wu, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 15 days.

(21) Appl. No.: 17/330,995

(22) Filed: May 26, 2021

(65) Prior Publication Data

US 2022/0094111 A1 Mar. 24, 2022

(30) Foreign Application Priority Data

Sep. 21, 2020 (CN) ..... 202022076263.4

(51) Int. Cl.

| | |
|---|---|
| ***H01R 13/6582*** | (2011.01) |
| *H01R 13/6581* | (2011.01) |
| *H01R 13/648* | (2006.01) |
| *H01R 13/658* | (2011.01) |
| *H01R 13/74* | (2006.01) |
| *H01R 13/73* | (2006.01) |
| *H01R 12/72* | (2011.01) |
| *H01R 13/6583* | (2011.01) |

(52) U.S. Cl.

CPC ..... *H01R 13/6582* (2013.01); *H01R 12/722* (2013.01); *H01R 13/648* (2013.01); *H01R 13/658* (2013.01); *H01R 13/6581* (2013.01); *H01R 13/6583* (2013.01); *H01R 13/73* (2013.01); *H01R 13/74* (2013.01)

(58) Field of Classification Search

CPC ..... H01R 13/6582; H01R 13/648; H01R 13/658; H01R 13/6581; H01R 13/73; H01R 13/74; H01R 12/722; H01R 13/6583

See application file for complete search history.

(56) References Cited

U.S. PATENT DOCUMENTS

| | | | | |
|---|---|---|---|---|
| 9,831,613 | B2 | 11/2017 | Liu et al. | |
| 2016/0322757 | A1* | 11/2016 | Liu | H01R 13/6583 |
| 2019/0036263 | A1* | 1/2019 | Avery | H01R 13/405 |

FOREIGN PATENT DOCUMENTS

| | | |
|---|---|---|
| CN | 204517046 U | 7/2015 |

* cited by examiner

*Primary Examiner* — Hae Moon Hyeon
*Assistant Examiner* — Justin M Kratt
(74) *Attorney, Agent, or Firm* — Birch, Stewart, Kolasch & Birch, LLP

(57) ABSTRACT

The present disclosure provides a connector with shielding elastic piece and a connector assembly. The connector with shielding elastic piece comprises a housing and an outer shielding elastic piece. The housing comprises an opening. One end of the outer shielding elastic piece is secured to an outer wall of the housing. The outer shielding elastic piece extends in a direction away from the opening and comprises a first contacting bump and a second contacting bump. The second contacting bump is disposed at one side of the first contacting bump away from the opening. The first contacting bump extends along the outer wall. The extending direction of the second contacting bump and the extending direction of the first contacting bump form an angle.

11 Claims, 10 Drawing Sheets

CONNECTOR WITH SHIELDING ELASTIC PIECE AND CONNECTOR ASSEMBLY

CROSS-REFERENCE TO RELATED APPLICATION

This application claims the priority benefit of Chinese Patent Application Serial Number 202022076263.4, filed on Sep. 21, 2020, the full disclosure of which is incorporated herein by reference.

BACKGROUND

Technical Field

The present disclosure relates to the technical field of shielding assembly against electromagnetic interference (EMI), particularly to a connector with shielding elastic piece and connector assembly.

Related Art

In the prior art, electromagnetic interference (EMI) refers to an interference phenomenon caused by the interaction of electromagnetic waves on electronic components. Conducted interference refers to the coupling (interference) of signals on one electrical network to another electrical network through a conductive medium. The interface of conventional connectors is provided with an elastic piece for shielding electromagnetic interference in that a local component of the elastic piece is connected to the casing to increase the electromagnetic shielding performance. However, when the local component of the elastic piece is in poor or no contact with the casing, the performance of electromagnetic interference shielding would be poor and unstable.

SUMMARY

The embodiments of the present disclosure provide a connector with shielding elastic piece and a connector assembly to solve the problem of poor shielding performance on shielding the electromagnetic interference.

On the first aspect, the present disclosure provides a connector with shielding elastic piece comprising a housing and an outer shielding elastic piece. The housing comprises an opening. One end of the outer shielding elastic piece is secured to an outer wall of the housing. The outer shielding elastic piece extends in a direction away from the opening and comprises a first contacting bump and a second contacting bump. The second contacting bump is disposed at one side of the first contacting bump away from the opening. The first contacting bump extends along the outer wall. The extending direction of the second contacting bump and the extending direction of the first contacting bump form an angle.

On the second aspect, the present disclosure provides a connector assembly comprising a connector with shielding elastic piece according to the first aspect and a mating connector comprising a connecting body and an inner shielding elastic piece. The inner shielding elastic piece surrounds the connecting body. The connecting body is inserted into the opening of the housing of the connector with shielding elastic piece. The inner shielding elastic piece is in contact with an inner wall of the housing.

In the embodiments of the present disclosure, the connector with shielding elastic piece is assembled on the periphery of the outer wall of the housing in a simple assembly manner through two outer shielding elastic pieces to perform electromagnetic interference shielding. Besides, the connector with shielding elastic piece is electrically connected with the mating connector. The outer shielding elastic piece is further in contact with an inner surface and an outer surface of the housing of the mating connector assembled thereto through a bumped surface of the first contacting bump and a bump surface of the second contacting bump to improve the stability of electromagnetic shielding for excellent electromagnetic shielding performance.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
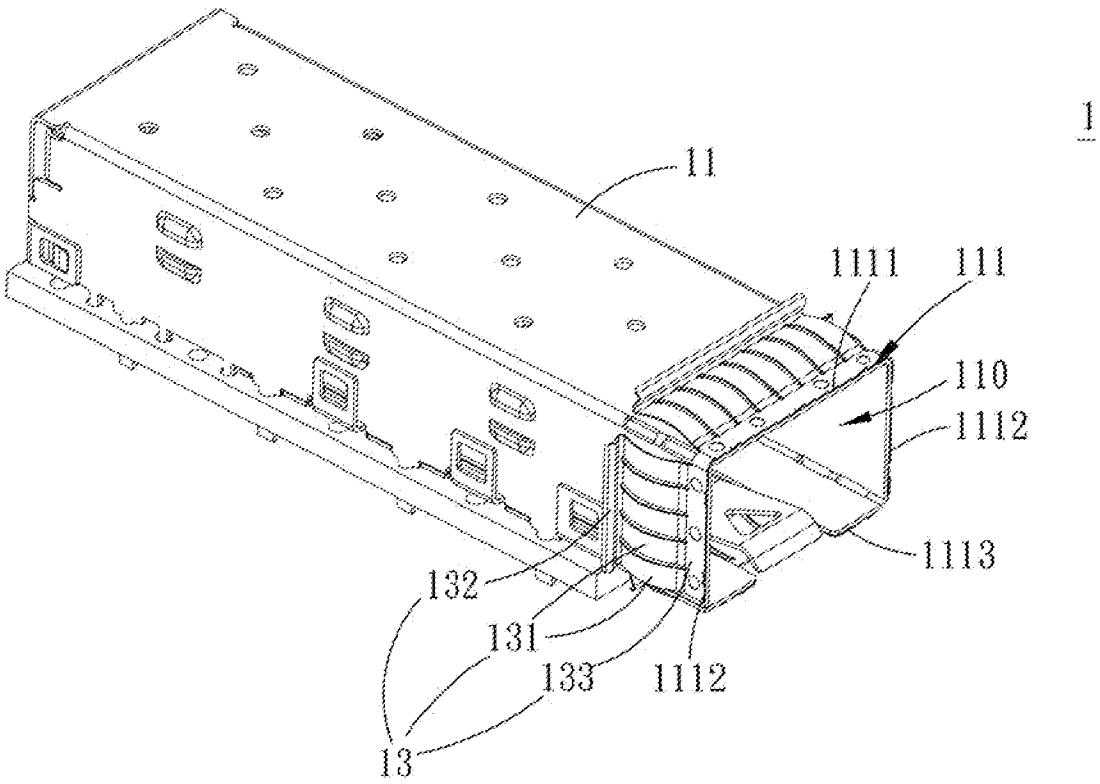
FIG. 1 is a perspective view of a connector with shielding elastic piece of the present disclosure.
Figure 2:
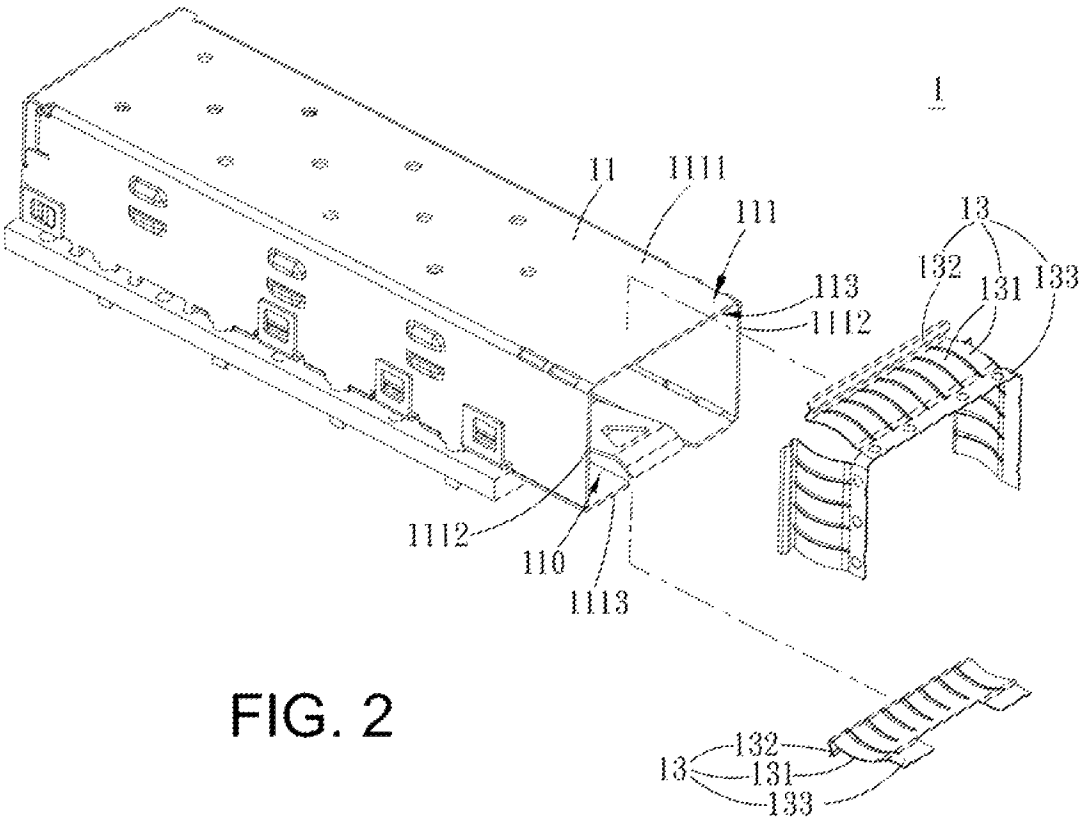
FIG. 2 is an exploded view of the connector with shielding elastic piece of the present disclosure.

FIG. 1 and FIG. 2 are perspective view and exploded view of a connector with shielding elastic piece of the present disclosure. As shown on the figures, in this embodiment, a connector 1 with shielding elastic piece comprises a housing 11 and an outer shielding elastic piece 13. The housing 11 comprises an opening 110. One end of the outer shielding elastic piece 13 is secured to an outer wall 111 of the housing 11. The outer shielding elastic piece 13 extends in a direction away from the opening 110 and comprises a first contacting bump 131 and a second contacting bump 132. The second contacting bump 132 is disposed at one side of the first contacting bump 131 away from the opening 110. The first contacting bump 131 extends along the outer wall 111. The extending direction of the second contacting bump 132 and the extending direction of the first contacting bump 131 form an angle.

Both the first contacting bump 131 and the second contacting bump 132 comprises a bump surface. The bump surface of the first contacting bump 131 protrudes toward a surface away from the outer wall 111, and the bump surface of the second contacting bump 132 protrudes toward one side with the first contacting bump 131. In this way, the protruding direction of the bump surface of the first contacting bump 131 would intersect the protruding direction of the bump surface of the second contacting bump 132.

In this embodiment, the number of the outer shielding elastic piece 13 is two. The outer wall 111 comprises a first surface 1111, two second surfaces 1112, and a third surface 1113. The third surface 1113 is opposite to the first surface 1111. The two second surfaces 1112 are oppositely disposed. Each of the second surfaces 1112 is disposed between the first surface 1111 and the third surface 1113. One end of one outer shielding elastic piece 13 of the two outer shielding elastic pieces 13 is secured to the first surface 1111 and the two second surfaces 1112. One end of the other outer shielding elastic piece 13 is secured to the third surface 1113. The two outer shielding elastic pieces 13 could form a frame configuration. In this embodiment, since the combined outer shielding elastic pieces 13 comprising two individual elements is assembled on the outer wall 111 of the housing 11, it is able to be assembled on the housing 11 and tolerating a greater dimensional tolerance for the assembly of the outer shielding elastic piece 13 with the housing 11.

Furthermore, each of the outer shielding elastic pieces 13 comprises a first contacting bump 131 and a second contacting bump 132. The number of the first contacting bumps 131 is multiple, and the number of the second contacting bumps 132 is multiple, the plurality of first contacting bumps 131 are disposed side by side at intervals. Each of the second contacting bumps 132 is disposed at one side of the corresponding plurality of first contacting bumps 131 away from the opening 110.

Besides, each of the outer shielding elastic pieces 13 comprises an outer connecting part 133. The outer connecting part 133 is disposed at one side of the plurality of first contacting bumps 131 close to the opening 110 and is secured to the outer wall 111. The two second surfaces 1112 the outer wall 111 are orthogonal to the first surface 1111 of the outer wall 111. The two second surfaces 1112 are orthogonal to the third surface 1113. The first surface 1111 corresponds to and is parallel to the third surface 1113. The plurality of first contacting bumps 131 are respectively disposed on the first surface 1111, the two second surfaces 1112, and the third surface 1113. The outer connecting part 133 is secured to the first surface 1111, the two second surfaces 1112, and the third surface 1113. In this embodiment, the outer connecting part 133 of the outer shielding elastic piece 13 is soldered to the outer wall 111.

Figure 3:
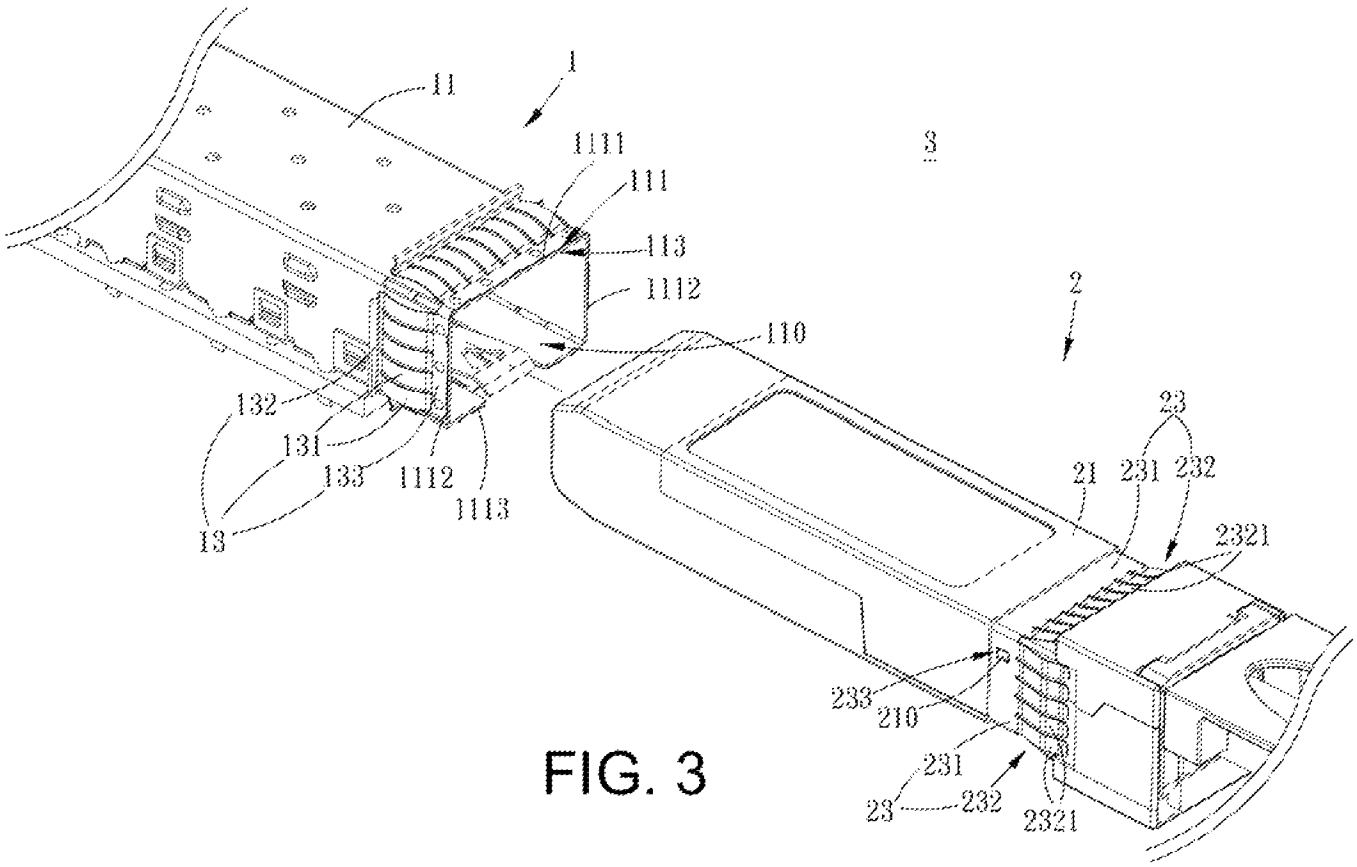
FIG. 3 is a perspective view showing the electrical connection between the connector with shielding elastic piece and a mating connector of the present disclosure.
Figure 4:
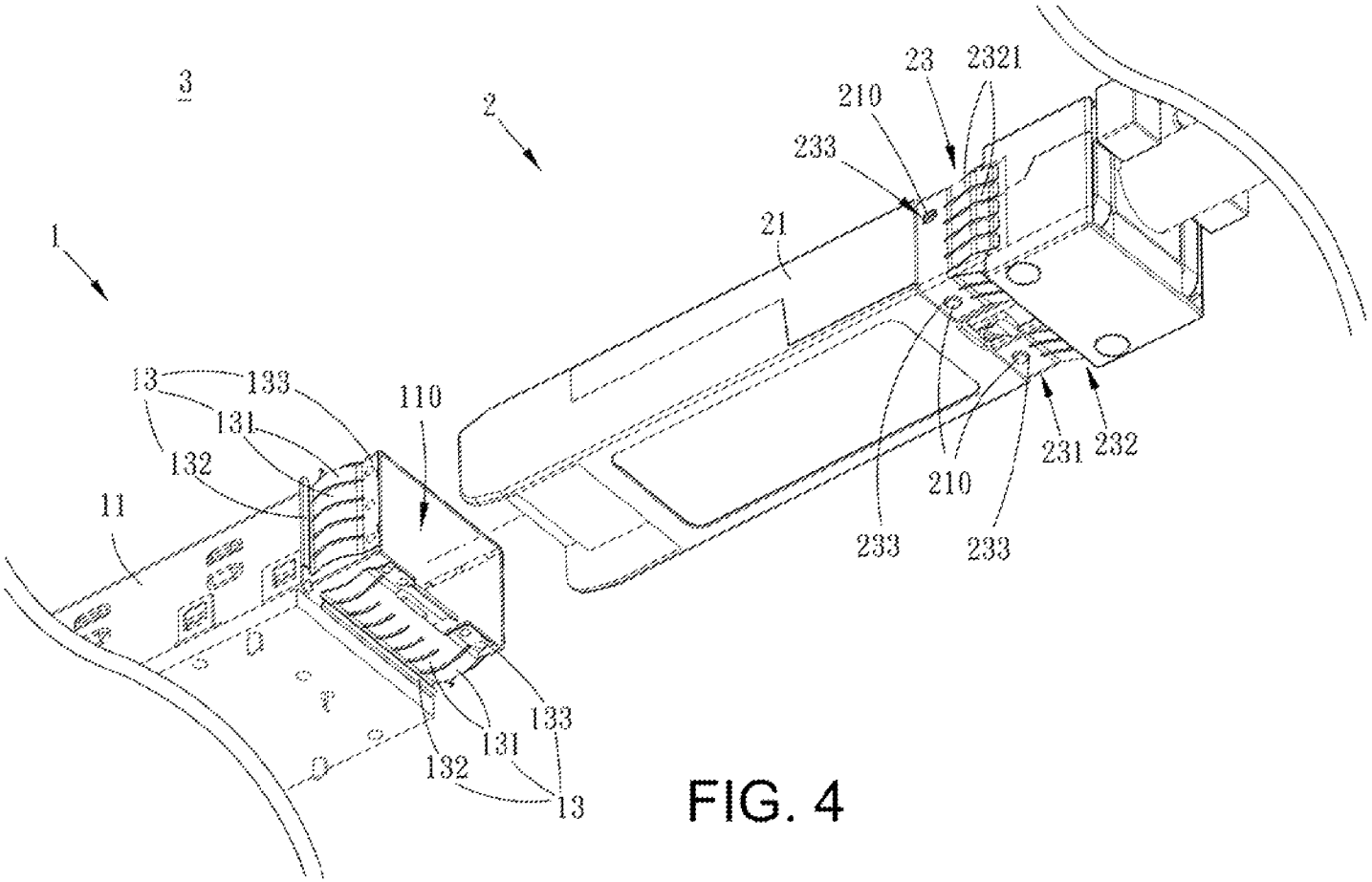
FIG. 4 is another perspective view showing the electrical connection between the connector with shielding elastic piece and the mating connector of the present disclosure.

FIG. 3 and FIG. 4 are perspective views showing the electrical connection between the connector with shielding elastic piece and a mating connector of the present disclosure. As shown in the figures, this embodiment provides a connector assembly 3 comprising a connector 1 with shielding elastic piece and a mating connector 2. The mating connector 2 comprises a connecting body 21 and an inner shielding elastic piece 23. The inner shielding elastic piece 23 surrounds the connecting body 21. The connecting body 21 is inserted into the opening 110 of the housing 11 of the connector 1 with shielding elastic piece. The inner shielding elastic piece 23 is in contact with an inner wall 113 of the housing 11.

Figure 5:
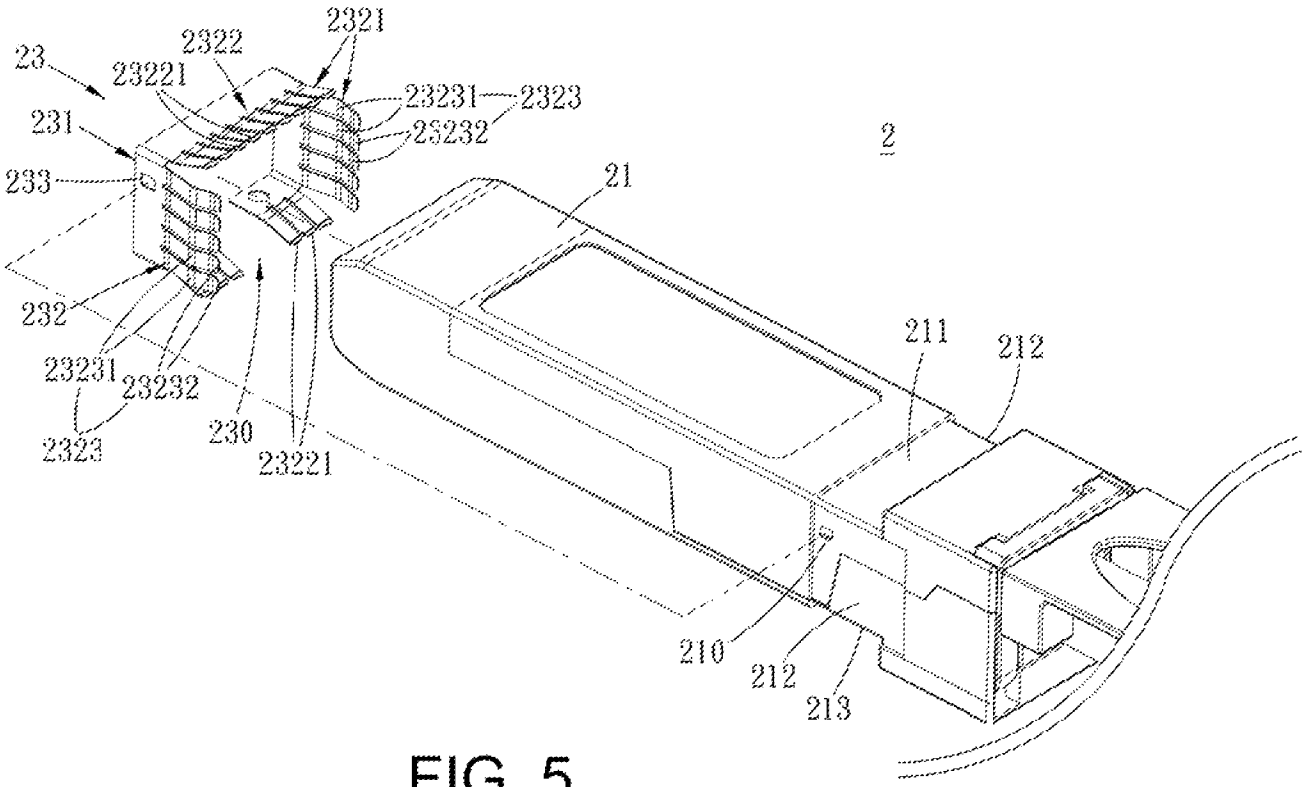
FIG. 5 is an exploded view of the mating connector of the present disclosure.

FIG. 5 is an exploded view of the mating connector of the present disclosure. As shown in the figure, in this embodiment, the inner shielding elastic piece 23 comprises an inner connecting member 231 and an elastic contacting member 232. The inner connecting member 231 is secured to the connecting body 21. The elastic contacting member 232 is disposed at one side of the inner connecting member 231 away from the connector 1 with shielding elastic piece. When the mating connector 2 is inserted into the connector 1 with shielding elastic piece, the elastic contacting member 232 would be in contact with the inner wall 113 of the opening 110. The elastic contacting member 232 comprises a plurality of contacting elastic arms 2321. The plurality of contacting elastic arms 2321 are disposed at intervals and are respectively connected with the inner connecting member 231.

In this embodiment, the connecting body 21 comprises a first body surface 211, two second body surfaces 212, and a third body surface 213. The third body surface 213 is opposite to the first body surface 211. The two second body surfaces 212 are oppositely disposed. Each of the second body surfaces 212 is disposed between the first body surface 211 and the third body surface 213. The connecting body 21 is a rectangular body. Moreover, the plurality of contacting elastic arms 2321 of the inner shielding elastic piece 23 comprise a plurality of first elastic arms 2322 and a plurality of second elastic arms 2323. The plurality of first elastic arms 2322 are disposed on the first body surface 211 and the third body surface 213. The plurality of second elastic arms 2323 are disposed on the two second body surfaces 212. The second elastic arm 2323 is longer than the first elastic arm 2322.

Besides, the inner shielding elastic piece 23 on the third body surface 213 comprises a gap 230. The connecting body 21 comprises a securing bump 210. The inner shielding elastic sheet 23 comprises a securing through hole 233. The securing bump 210 protrudes from the securing through hole 233 for securing. The inner shielding elastic sheet 23 and the connecting body 21 are mutually secured by structural engaging.

Figure 6:
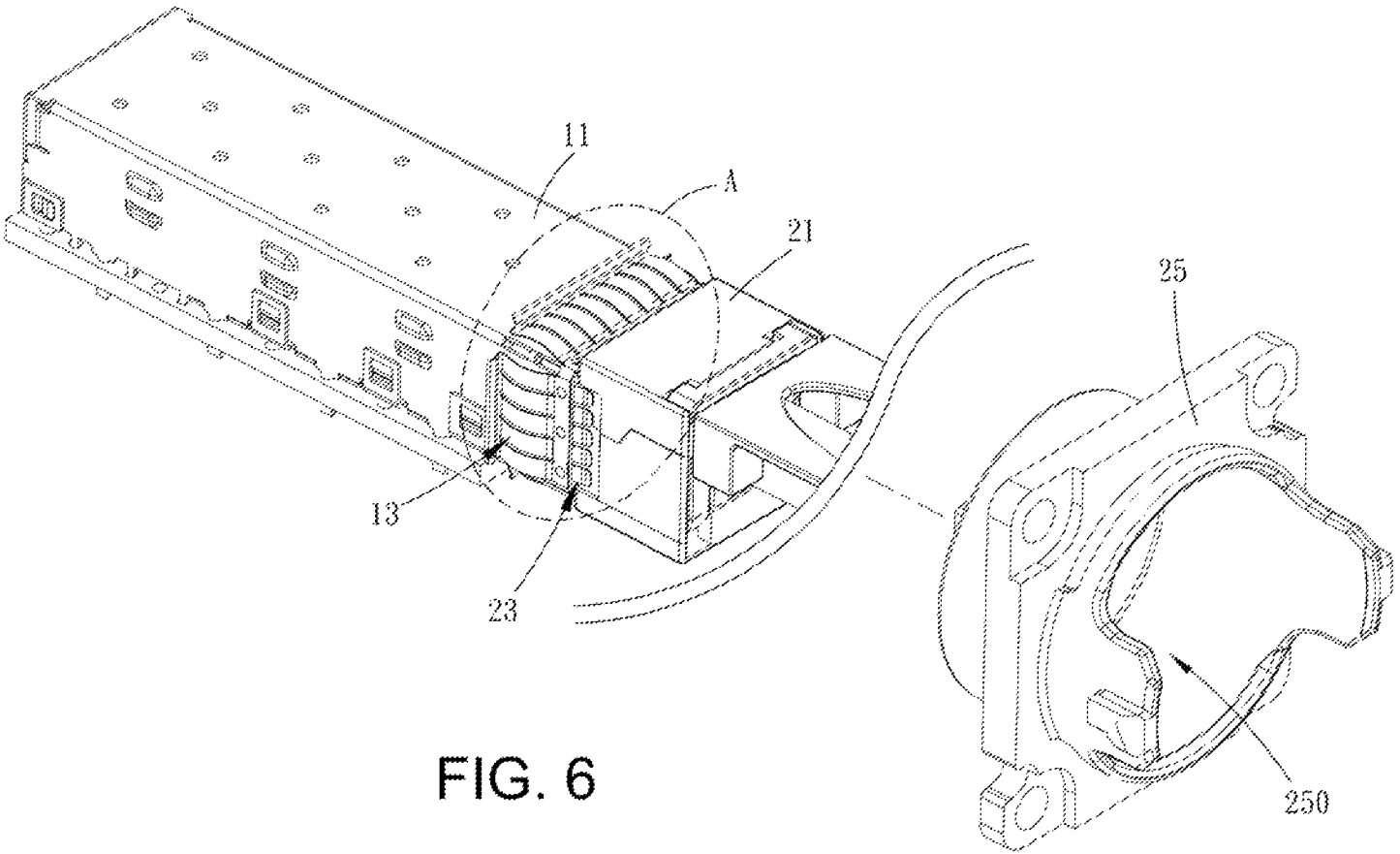
FIG. 6 is an exploded assembly diagram of a connector assembly of the present disclosure.
Figure 7:
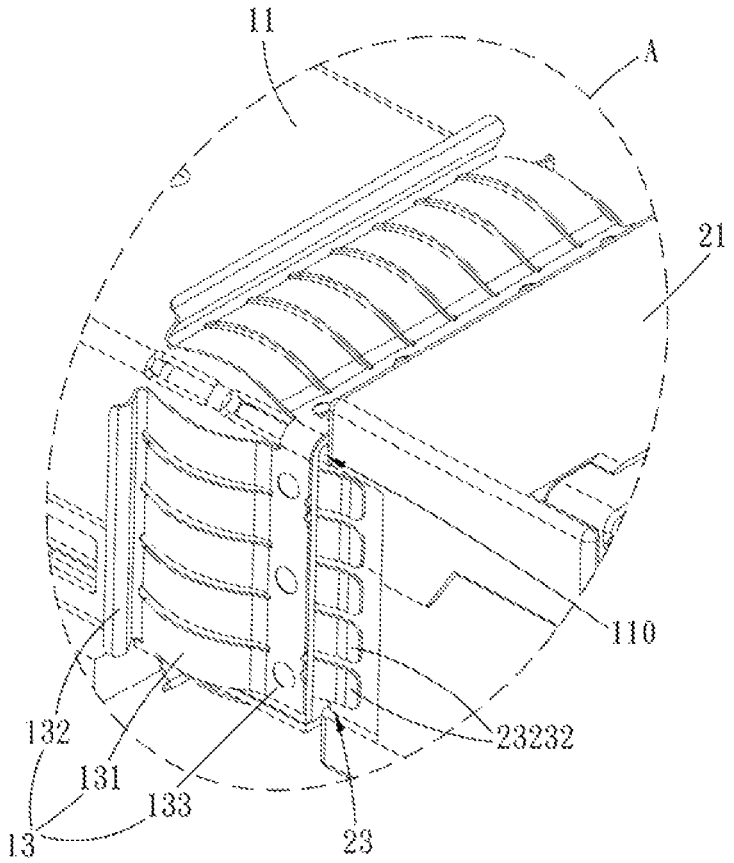
FIG. 7 is an enlarged view of area A of FIG. 6.
Figure 8:
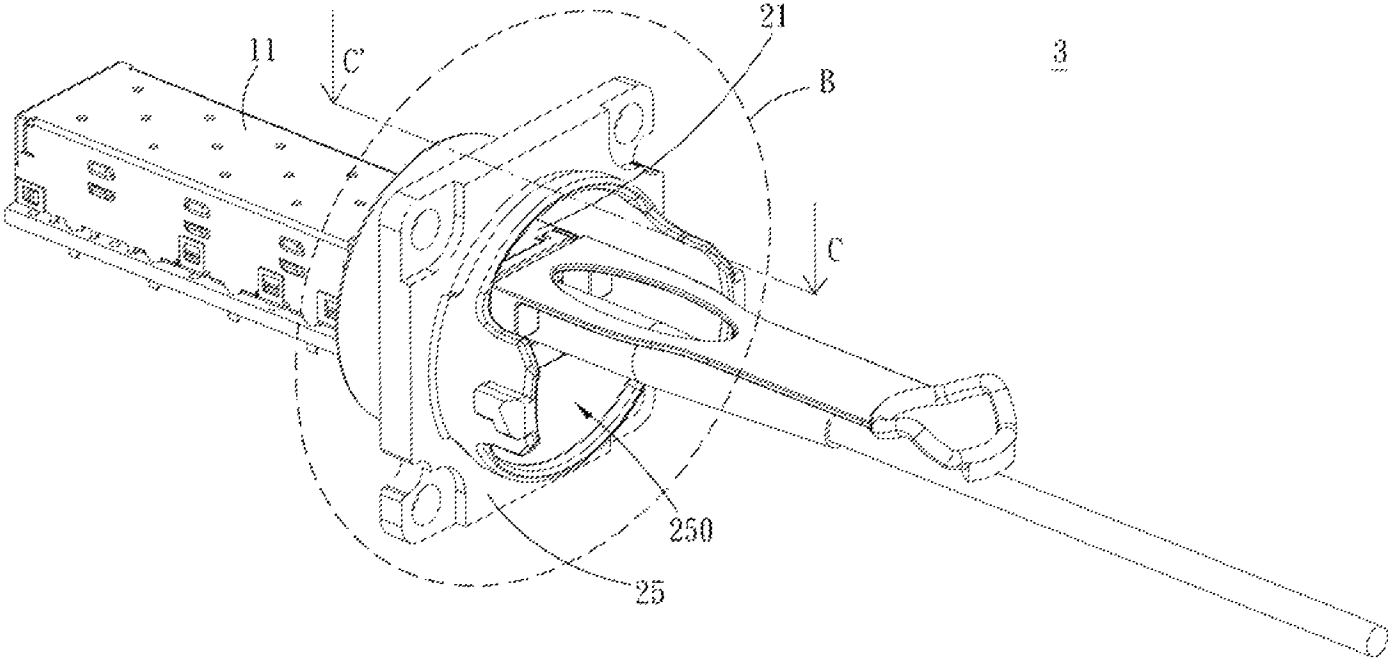
FIG. 8 is a perspective view of the connector assembly of the present disclosure.
Figure 9:
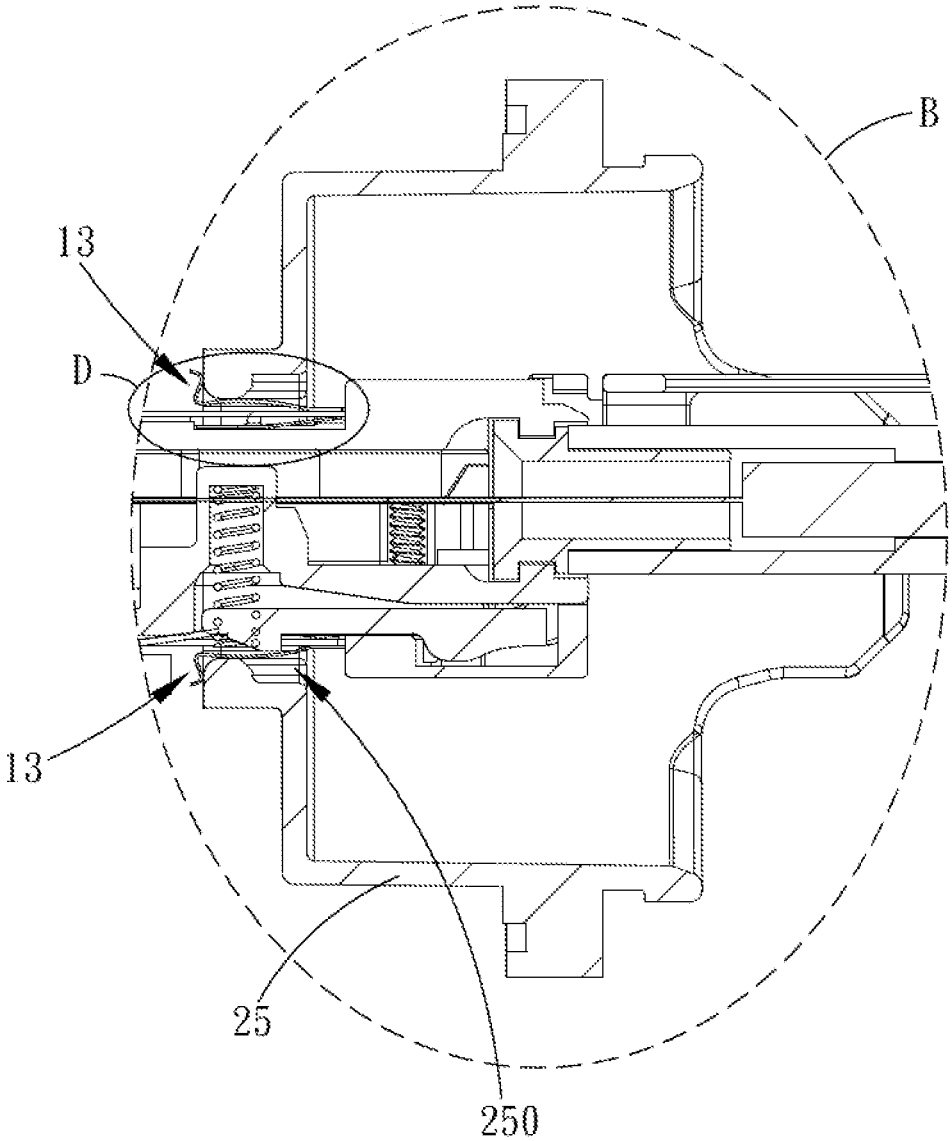
FIG. 9 is an enlarged cross-sectional view along line C-C' of area B of FIG. 8.
Figure 10:
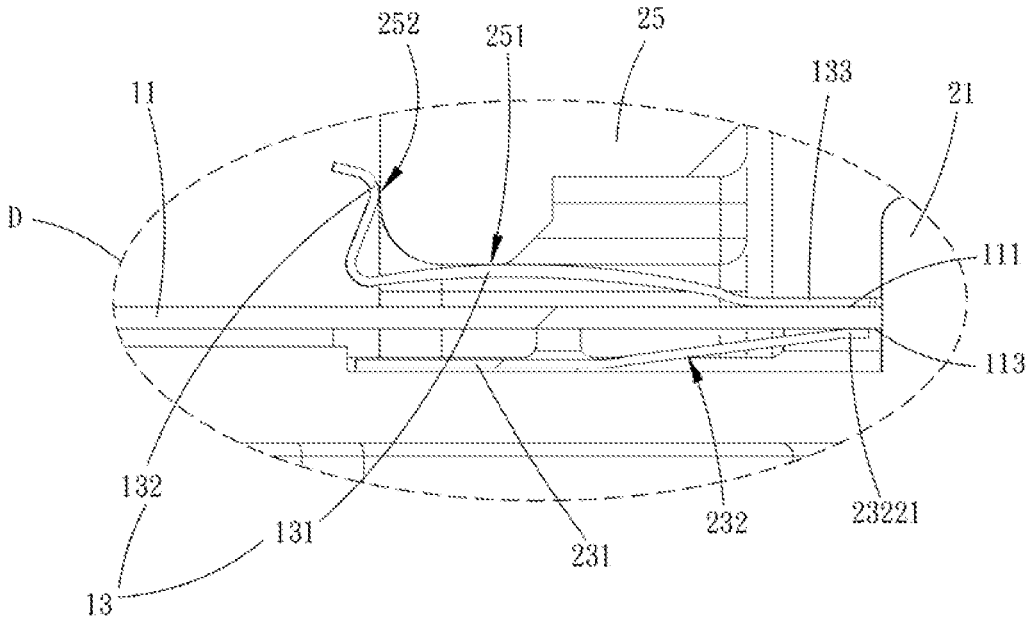
FIG. 10 is an enlarged view of area D of FIG. 9.

FIG. 6 is an exploded assembly diagram of a connector assembly of the present disclosure. FIG. 7 is an enlarged view of area A of FIG. 6. FIG. 8 is a perspective view of the connector assembly of the present disclosure. FIG. 9 is an enlarged cross-sectional view along line C-C' of area B of FIG. 8. FIG. 10 is an enlarged view of area D of FIG. 9. As shown in the figures, in this embodiment, the mating connector 2 further comprises a casing 25, which is a protective shell of the connecting body 21, comprising an accommodating opening 250. The connecting body 21 passes through the accommodating opening 250. When the mating connector 2 is inserted into the connector 1 with shielding elastic piece, the first contacting bump 131 of the connector 1 with shielding elastic piece would be in contact with an inner surface 251 of the accommodating opening 250 of the casing 25, and the second contacting bump 132 would abut against an outer surface 252 of the accommodating opening 250 of the casing 25. The bump surface of the first contacting bump 131 can be ensured to be in contact with the inner surface of the casing 25, and the bump surface of the second contacting bump 132 can be ensured to be in contact with the outer surface of the casing 25 to reduce poor or inaccessible contact between the outer shielding elastic piece 13 and the casing 25, thereby improving the stability of electromagnetic shielding.

Back to FIG. 10, each of the first elastic arms 2322 comprises a first contacting part 23221 in contact with the inner wall 113 of the opening 110. Each of the second elastic arms 2323 comprises a second contacting part 23231 and an abutting part 23232. The abutting part 23232 is disposed at one end of the second elastic arm 2323 away from the inner connecting member 231. The second contacting part 23231 is disposed between the abutting part 23232 and the inner connecting member 231. The second contacting part 23231 is in contact with the inner wall 113 of the opening 110. The abutting part 23232 is in contact with the second body surface 212 of the connecting body 21 and protrudes from the opening 110 of the housing 110, as shown in FIG. 7.

In this embodiment, when the connecting body 21 of the mating connector 2 is inserted into the opening 110 of the housing 11 of the connector 1 with shielding elastic piece, the inner shielding elastic piece 23 of the mating connector 2 would be in contact with the inner wall 113 of the housing 11 of the connector 1 with shielding elastic piece. Also, the connector 1 with shielding elastic piece would be assembled in the casing 25 of the mating connector 2, and the first contacting bump 131 of the outer shielding elastic piece 13 would abut against and be in contact with the inner surface 251 of the accommodating opening 250 of the casing 25. Meanwhile, the second contacting bump 132 of the outer shielding elastic piece 13 would also abut against the outer surface 252 of the accommodating opening 250. In this embodiment, with the first contacting bump 131 and the second contacting bump 132 of the outer shielding elastic piece 13 being in contact with the inner surface 251 and outer surface 252 of the casing 25 of the mating connector 2, the stability of electromagnetic shielding can be improved and a better electromagnetic shielding performance can be achieved.

In summary, the embodiments of the present disclosure provide a connector with shielding elastic piece and a connector assembly. The connector with shielding elastic piece is assembled on the periphery of the outer wall of the housing in a simple assembly manner through two outer shielding elastic pieces to perform electromagnetic interference shielding. Besides, the connector with shielding elastic piece is electrically connected with the mating connector. The outer shielding elastic piece is further in contact with an inner surface and an outer surface of the housing of the mating connector assembled thereto through a bump surface of the first contacting bump and a bump surface of the second contacting bump to improve the stability of electromagnetic shielding for excellent electromagnetic shielding performance.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A connector assembly, comprising:

a connector with shielding elastic piece, comprising:

a housing comprising an opening; and an outer shielding elastic piece, one end of which being secured to an outer wall of the housing, the outer shielding elastic piece extending in a direction away from the opening and comprising a first contacting bump and a second contacting bump, the second contacting bump being disposed at one side of the first contacting bump away from the opening, the first contacting bump extending along the outer wall, the extending direction of the second contacting bump and the extending direction of the first contacting bump forming an angle; and a mating connector, comprising:

a connecting body comprising a first body surface, two second body surfaces and a third body surface; the third body surface being opposite to the first body surface; the two second body surfaces being oppositely disposed; each of the second body surfaces being disposed between the first body surface and the third body surface; the first body surface, the two second body surfaces and the third body surface are outside surfaces of the connecting body; and an inner shielding elastic piece, wherein the inner shielding elastic piece is secured on the first body surface, the two second body surfaces and the third body surface of the connecting body and surrounds, wherein the inner shielding elastic piece comprises an elastic contacting member, and wherein the elastic contacting member comprises a plurality of contacting elastic arms;

wherein the connecting body is inserted into the opening of the housing of the connector with shielding elastic piece; the inner shielding elastic piece is in contact with an inner wall of the housing;

wherein the plurality of contacting elastic arms of the inner shielding elastic piece comprise a plurality of first elastic arms and a plurality of second elastic arms; the plurality of first elastic arms are disposed on the first body surface and the third body surface; the plurality of second elastic arms are disposed on the two second body surfaces; the second elastic arm is longer than the first elastic arm;

wherein each of the second elastic arms comprises a second contacting part and an abutting part; the abutting part is disposed at one end of the second elastic arm away from an inner connecting member of the inner shielding elastic piece; the second contacting part is disposed between the abutting part and the inner connecting member; the second contacting part is in contact with the inner wall of the opening; the abutting part is in contact with the second body surface of the connecting body and protrudes from the opening of the housing.

2. The connector assembly according to claim 1, wherein the mating connector further comprises a casing comprising an accommodating opening; the connecting body passes through the accommodating opening; when the mating connector is inserted into the connector with shielding elastic piece, the first contacting bump is in contact with an inner surface of the accommodating opening, the second contacting bump abuts against an outer surface of the accommodating opening.

3. The connector assembly according to claim 1, wherein the inner shielding elastic piece comprises the inner connecting member and the elastic contacting member; the inner connecting member is secured to the connecting body; the elastic contacting member is disposed at one side of the inner connecting member away from the connector with shielding elastic piece; when the mating connector is inserted into the connector with shielding elastic piece, the elastic contacting member is in contact with the inner wall of the opening.

4. The connector assembly according to claim 3, wherein the plurality of contacting elastic arms are disposed at intervals and are respectively connected with the inner connecting member.

5. The connector assembly according to claim 1, wherein each of the first elastic arms comprises a first contacting part; the first contacting part is in contact with the inner wall of the opening.

6. The connector assembly according to claim 1, wherein the inner shielding elastic piece on the third body surface comprises a gap.

7. The connector assembly according to claim 1, wherein the connecting body comprises a securing bump protruding therefrom; the inner shielding elastic sheet comprises a securing through hole; the securing bump protrudes from extends through the securing through hole for securing.

8. The connector assembly according to claim 1, wherein the number of the outer shielding elastic piece is two; the outer wall comprises a first surface, two second surfaces, and a third surface; the third surface is opposite to the first surface; the two second surfaces are oppositely disposed; each of the second surfaces is disposed between the first surface and the third surface; one end of one outer shielding elastic piece of the two outer shielding elastic pieces is secured to the first surface and the two second surfaces; one end of the other outer shielding elastic piece is secured to the third surface.

9. The connector assembly according to claim 1, wherein the outer shielding elastic piece further comprises an outer connecting part; the outer connecting part is disposed at one side of the first contacting bump close to the opening and is secured to the outer wall.

10. The connector assembly according to claim 1, wherein the number of the first contacting bumps is multiple; the number of the second contacting bumps is multiple; the first contacting bumps are disposed at intervals; each of the second contacting bumps is disposed at one side of the corresponding plurality of first contacting bumps away from the opening; the outer connecting part is disposed at one side of the plurality of first contacting bumps close to the opening.

11. The connector assembly according to claim 10, wherein the housing comprising a first surface and two second surfaces; the two second surfaces are respectively connected with two sides of the first surface; the two second surfaces are orthogonal to the first surface; the plurality of first contacting bumps are disposed on the first surface and the second surface; the outer connecting part is secured on the first surface and the two second surfaces.

* * * * *